US010139048B2

(12) United States Patent
Sassi et al.

(10) Patent No.: US 10,139,048 B2
(45) Date of Patent: Nov. 27, 2018

(54) SEALED AND THERMALLY INSULATING TANK EQUIPPED WITH A REINFORCING PIECE

(71) Applicant: GAZTRANSPORT ET TECHNIGAZ, Saint Remy les Chevreuse (FR)

(72) Inventors: Mohamed Sassi, Meudon-la-foret (FR); Antoine Philippe, Gif sur Yvette (FR); Julien Couteau, Bressuire (FR)

(73) Assignee: GAZTRANSPORT ET TECHNIGAZ, Saint Remy Les Chevreuse (FR)

( * ) Notice: Subject to any disclaimer, the term of this patent is extended or adjusted under 35 U.S.C. 154(b) by 0 days.

(21) Appl. No.: 15/742,718

(22) PCT Filed: Jul. 15, 2016

(86) PCT No.: PCT/FR2016/051825
§ 371 (c)(1),
(2) Date: Jan. 8, 2018

(87) PCT Pub. No.: WO2017/017337
PCT Pub. Date: Feb. 2, 2017

(65) Prior Publication Data

US 2018/0202611 A1 Jul. 19, 2018

(30) Foreign Application Priority Data

Jul. 24, 2015 (FR) ..... 15 57040

(51) Int. Cl.
*F17C 13/00* (2006.01)
*B63B 3/68* (2006.01)
(Continued)

(52) U.S. Cl.
CPC ..... *F17C 13/004* (2013.01); *B63B 3/68* (2013.01); *B63B 25/16* (2013.01); *B65D 90/027* (2013.01);
(Continued)

(58) Field of Classification Search
CPC ..... F17C 13/004; B63B 3/68; B63B 25/16
See application file for complete search history.

(56) References Cited

U.S. PATENT DOCUMENTS 5,647,184 A * 7/1997 Davis ..... C08L 23/10 52/100
5,676,486 A * 10/1997 Keith ..... F16B 5/0614 248/300
(Continued)

FOREIGN PATENT DOCUMENTS

FR 2936784 A1 4/2010
KR 20130119399 A 10/2013
(Continued)

OTHER PUBLICATIONS

International Search Report for corresponding PCT application No. PCT/FR2016/051825, dated Oct. 28, 2016.

*Primary Examiner* — Stephen P Avila
(74) *Attorney, Agent, or Firm* — Notaro, Michalos & Zaccaria P.C.

(57) ABSTRACT

A sealed and thermally insulating tank having a sealing membrane, a thermal insulation barrier, and a reinforcing piece for reinforcing the sealing membrane against the pressure of the fluid contained in the tank. The thermal insulation barrier has a groove parallel to the longitudinal direction of the corrugation, and the reinforcing piece has a retaining rib engaged in the groove, the retaining rib forming a lug extending in the groove beyond a longitudinal end of the main body in the longitudinal direction of the corrugation. A stop element attached to the thermal insulation barrier stops the reinforcing piece in the longitudinal direction of the corrugation in a first direction and cooperates with the lug to stop the reinforcing piece in a direction moving away from the support surface.

18 Claims, 9 Drawing Sheets

(51) Int. Cl.

| | |
|---|---|
| ***B63B 25/16*** | (2006.01) |
| ***B65D 90/02*** | (2006.01) |
| ***B65D 90/06*** | (2006.01) |
| ***B65D 90/22*** | (2006.01) |
| ***F17C 3/02*** | (2006.01) |
| ***F17C 3/04*** | (2006.01) |
| ***F17C 13/08*** | (2006.01) |

(52) U.S. Cl.

CPC ..... *B65D 90/06* (2013.01); *B65D 90/22* (2013.01); *F17C 3/027* (2013.01); *F17C 3/04* (2013.01); *F17C 13/001* (2013.01); *F17C 13/082* (2013.01); *F17C 2201/0157* (2013.01); *F17C 2201/052* (2013.01); *F17C 2203/0358* (2013.01); *F17C 2203/0631* (2013.01); *F17C 2203/0682* (2013.01); *F17C 2221/033* (2013.01); *F17C 2223/0161* (2013.01); *F17C 2223/033* (2013.01); *F17C 2260/013* (2013.01); *F17C 2270/0107* (2013.01)

(56) References Cited

U.S. PATENT DOCUMENTS

| | | | | |
|---|---|---|---|---|
| 5,848,767 | A * | 12/1998 | Cappa | B64G 1/10 244/158.1 |
| 6,076,788 | A * | 6/2000 | Akiyama | E04B 9/006 248/200.1 |
| 7,900,416 | B1 * | 3/2011 | Yokubison | E04F 15/10 52/177 |
| 10,006,613 | B2 * | 6/2018 | Oudina | F21V 21/048 |

FOREIGN PATENT DOCUMENTS

| | | | |
|---|---|---|---|
| WO | 2012020194 | A1 | 2/2012 |
| WO | 2014125186 | A1 | 8/2014 |

* cited by examiner

SEALED AND THERMALLY INSULATING TANK EQUIPPED WITH A REINFORCING PIECE

TECHNICAL FIELD

The invention relates to the field of sealed and thermally insulated tanks with corrugated metallic membranes, for the storage and/or transport of a fluid such as a cryogenic fluid.

Sealed and thermally insulating tanks with corrugated metallic membranes are used in particular for the storage of liquefied natural gas (LNG) which is stored at atmospheric pressure at around −162° C.

TECHNOLOGICAL BACKGROUND

FR-A-2936784 describes a tank with a corrugated sealing membrane reinforced with reinforcing pieces arranged below the corrugations, between the sealing membrane and the support of this sealing membrane, to reduce stresses in the sealing membrane caused by a multitude of factors such as the thermal shrinkage when the tank is chilled, the effect of flexion of the ship's beam, and dynamic pressure due to movement of the cargo, in particular because of the swell. These hollow reinforcing pieces allow gas to circulate between the corrugations and the support, passing through the reinforcing pieces.

Several solutions have been considered for fixing such reinforcing pieces to the tank wall. It has been proposed to fix the reinforcing pieces to the sealing membrane, for example in FR-A-2936784 (FIG. 12) and WO-A-2012020194. It has been considered to fix the reinforcing pieces to the thermal insulation barrier, for example in FR-A-2936784 (FIG. 11). In all cases, the fixing of the reinforcing pieces must be reliable in order to prevent a reinforcing piece, which has come detached from its support, from causing impacts, in particular against the sealing membrane, which would risk accelerating the fatigue of the materials and increasing leaks.

KR-A-20130119399 teaches a reinforcing element equipped with elastic coupling parts intended to be fixed in holes formed on the upper surface of an insulating panel. However, such elastic coupling parts have the following drawbacks:

- These elastic coupling parts do not also allow reliable stoppage of a translation movement in a longitudinal direction of a groove, since they must have a degree of elasticity necessary for their installation.
- It is difficult for these elastic coupling parts to ensure an adequate fixing of the reinforcing elements because of the installation tolerances, thermal contractions during chilling of the tank, and elongations of the ship which tend to move the panels apart from each other.

SUMMARY

A concept on which the invention is based is to propose a tank with a reinforced corrugated sealing membrane, in which reinforcing pieces may be attached in a simple and reliable fashion during assembly of the tank wall.

To achieve this, the invention provides a sealed and thermally insulating tank intended for transport of a fluid, said tank comprising a tank wall fixed to a carrier wall, the tank wall comprising:

a sealing membrane intended to be in contact with the fluid contained in the tank, the sealing membrane comprising a layer of corrugated metal sheet with at least one series of parallel corrugations protruding towards the inside of the tank, and flat portions situated between the corrugations, a thermal insulation barrier arranged between the carrier wall and the sealing membrane and having a support surface on which the flat portions of the sealing membrane rest, and a reinforcing piece for reinforcing the sealing membrane against the pressure of the fluid contained in the tank, the reinforcing piece comprising a main body inserted in a corrugation of the sealing membrane between the sealing membrane and the support surface, the main body having an elongate form in a longitudinal direction of the corrugation and a base surface resting on the support surface, wherein the thermal insulation barrier comprises a groove parallel to the longitudinal direction of the corrugation and opening through the support surface, and the reinforcing piece comprises a retaining rib protruding relative to the base surface of the main body and engaged in the groove of the thermal insulation barrier, the retaining rib forming a first end lug extending in the groove beyond a first longitudinal end of the main body in the longitudinal direction of the corrugation, the tank wall also comprising a stop element attached to the thermal insulation barrier and arranged on the support surface at a position adjacent to the first longitudinal end of the main body level with the first end lug, such that the stop element cooperates with the first longitudinal end of the main body to stop the reinforcing piece in the longitudinal direction of the corrugation in a first direction, and with the first end lug to stop the reinforcing piece in a direction moving away from the support surface.

Thanks to these characteristics, it is possible to fix the reinforcing piece to the thermal insulation barrier in a simple and reliable fashion, given that the stop element need simply be positioned on the support surface near the longitudinal end of the reinforcing piece in order to fit over the lug. Since the stop element jointly forms a stop of the reinforcing piece both in the longitudinal direction and in the thickness direction of the tank wall, this ensures a saving of means.

According to advantageous embodiments, such a sealed and thermally insulating tank may have one or more of the following characteristics.

According to one embodiment, the retaining rib is a first retaining rib which is laterally offset in a first direction relative to half the width of the base surface of the main body, wherein the reinforcing piece also comprises a second retaining rib protruding relative to the base surface of the main body and laterally offset in the second direction relative to half the width of the base surface of the main body, the thermal insulation barrier also comprising a second groove parallel to the longitudinal direction of the corrugation, which opens through the support surface and in which the second retaining rib is engaged, the second retaining rib forming an end lug extending in the second groove beyond the first or second longitudinal end of the main body in the longitudinal direction of the corrugation, the tank wall also comprising a stop element attached to the thermal insulation barrier and arranged on the support surface at a position adjacent to the first or second longitudinal end of the main body level with the end lug of the second retaining rib, such that the stop element cooperates with the first or second longitudinal end of the main body to stop the reinforcing piece in the longitudinal direction of the corrugation in the first or second direction, and with the end lug of the second retaining rib to stop the reinforcing piece in the direction moving away from the support surface.

The first and second retaining ribs are thus arranged on either side of the median longitudinal axis of the main body. According to embodiments, the second retaining rib may be configured identically to or differently from the first retaining rib. According to one embodiment, each of the first and second retaining ribs comprises a first end lug and a second end lug. According to another embodiment, the first retaining rib comprises only a first end lug, and the second retaining rib comprises only a second end lug.

According to one embodiment, the retaining rib forms a second end lug extending in the groove beyond a second longitudinal end of the main body in the longitudinal direction of the corrugation, the tank wall also comprising a second stop element attached to the thermal insulation barrier and arranged on the support surface at a position adjacent to the second longitudinal end of the main body level with the second end lug, such that the second stop element cooperates with the second longitudinal end of the main body to stop the reinforcing piece in the longitudinal direction of the corrugation in a second direction, and with the second end lug to stop the reinforcing piece in the direction moving away from the support surface of the thermal insulation barrier.

According to one embodiment, the or each retaining rib has a length which is greater than the length of the main body, so as to extend over the entire length of the main body and form the first end lug and the second end lug extending in the groove between the two longitudinal ends of the main body in the longitudinal direction of the corrugation.

Thus in this embodiment, the or each retaining rib has a continuous form between the two end lugs. Conversely, in other embodiments, the or each retaining rib may be interrupted between the two end lugs, for example along the central portion of the length of the main body, and thus have a discontinuous form.

According to one embodiment, the retaining rib is positioned halfway across the width of the base surface of the main body.

There are numerous possibilities for producing the stop element. According to one embodiment, the or each stop element straddles the groove in which the first or second end lug, that must cooperate with the stop element, is engaged.

According to one embodiment, the or each stop element is attached the thermal insulation barrier on a single side of the groove in which the first or second end lug, that must cooperate with the stop element, is engaged. Thanks to these characteristics, the dimensioning of the stop element may be simplified, given that it is not necessary to take precise account of any variations in width of the groove during function of the tank, for example under the effects of temperature changes or others.

According to one embodiment, the or each stop element is attached to the thermal insulation barrier on both sides of the groove in which the first or second end lug that must cooperate with the stop element is engaged.

The main body of the reinforcing piece may be produced with various geometries, as illustrated in FR-A-2936784, depending in particular on the geometry of the corrugations of the sealing membrane. Preferably, the outer form of the main body is adapted to the inner form of the corrugation in which the main body is inserted, so as to provide effective support of substantially the entire surface of the corrugation. According to a preferred embodiment, the outer form of the cross-section of the main body is a semi-elliptical dome. If the reinforcing piece is made from a material with a thermal behavior different from that of the sealing membrane, its dimensioning must take account of this difference in order to effectively support the wall of the corrugation at the usage temperature, for example −162° C. for LNG.

According to a preferred embodiment, the main body of the reinforcing piece has a hollow tubular form open at the two longitudinal ends of the main body. Thus the inner space of the corrugations of the sealing membrane is not sealed or divided by the reinforcing piece, and may be utilized for circulation of the gas, in particular dinitrogen or another inert gas, in order to render the tank wall inert and/or detect leaks. According to a preferred embodiment, the ribs may be arranged in such a hollow tubular section, as illustrated in FR-A-2936784, in order to increase the pressure-resistance of the reinforcing piece while using relatively thin thicknesses in the outer envelope of the main body.

According to a preferred embodiment, the retaining rib has a rectangular cross-section. In a variant, the retaining rib has a cross-section of inverted T-shape.

Preferably, apart from the ends, the reinforcing piece has a profiled geometry of constant cross-section, which facilitates production of a piece of the desired length by cutting a profiled body of long length. Such a profiled body may be produced in particular by extrusion together with the retaining rib. The longitudinal end of the reinforcing piece, in particular the end lug, may be shaped by a subsequent machining operation.

According to embodiments, the reinforcing pieces are made of materials such as metal, in particular aluminum, metal alloys, plastic materials, in particular polyethylene, polycarbonate, polyetherimide, or composite materials comprising fibers, in particular glass fibers, bonded by a plastic resin.

According to one embodiment, the reinforcing piece also comprises a thickness shim fixed to a side face of the retaining rib to adapt a thickness of the retaining rib to a width of the groove in which the retaining rib is engaged.

Thanks to such a thickness shim, it is possible to adjust the thickness of the retaining rib locally or over its entire length, depending on the width of the groove in the thermal insulation barrier, in order to obtain a lightly clamped engagement which promotes the holding of the reinforcing piece in position without substantially complicating the installation of the reinforcing pieces on the thermal insulation barrier. By providing several thickness shims of different dimensions, it is also possible to adapt standardized reinforcing pieces to grooves of different widths, each time fitting shims of suitable thickness to the retaining rib, on one side face or on both side faces of the retaining rib.

According to one embodiment, the reinforcing piece comprises an elongate shim of the same length as the retaining rib, the elongate shim having a U-shaped profile engaged on the retaining rib by the open side of the U-shaped profile, and having a first and a second fixing tab straddling the open side of the U-shaped profile at the two longitudinal ends of the elongate shim, in order to cooperate with an upper surface of the first end lug and an upper surface of the second end lug.

According to embodiments, the stop element may be supplied separately from such an elongate shim. According to one embodiment, the first and second stop elements are formed integrally with the elongate shim. According to a particular embodiment, the first and second stop elements are formed integrally with the first and second fixing tabs respectively.

There are numerous possibilities for producing the thermal insulation barrier. Preferably, the thermal insulation barrier comprises a plurality of parallelepipedic insulating modules juxtaposed in a repeated pattern. Materials which can be used for such parallelepipedic insulating modules are in particular cellular foam, in particular polyurethane foam, in some cases reinforced with impregnated fibers, glass wool, balsa, plywood, according to the known art.

According to one embodiment, the groove of the thermal insulation barrier opening through the support surface consists of a gap between two juxtaposed parallelepipedic insulating modules. According to another embodiment, the groove of the thermal insulation barrier opening through the support surface consists of a stress-relief slot cut into a parallelepipedic insulating module and extending over a portion of the thickness of the parallelepipedic insulating module. These two embodiments may be combined in a tank, namely by attaching certain reinforcing pieces to the gaps between juxtaposed parallelepipedic insulating modules, and other reinforcing pieces to stress-relief slots cut into parallelepipedic insulating modules.

Reinforcing pieces as described above may be combined in various ways, in particular by sharing a stop element so that several reinforcing pieces are held jointly on the insulation barrier. According to a corresponding embodiment, the reinforcing piece is a first reinforcing piece, the tank also comprising a second reinforcing piece comprising a main body inserted in said corrugation of the sealing membrane between the sealing membrane and the support surface in the alignment of the first reinforcing piece, on the side of the first longitudinal end of the first reinforcing piece, the main body of the second reinforcing piece having an elongate form in the longitudinal direction of the corrugation and a base surface resting on a support surface, the second reinforcing piece comprising a retaining rib protruding relative to the base surface of the main body and engaged in the groove of the thermal insulation barrier, the retaining rib forming a first end lug extending in the groove beyond a first longitudinal end of the main body turned towards the first longitudinal end of the first reinforcing piece, wherein the stop element is arranged on the support surface between the first longitudinal end of the first reinforcing piece and the first longitudinal end of the second reinforcing piece, level with the first end lugs of the first reinforcing piece and the second reinforcing piece, such that the stop element cooperates with the first longitudinal ends of the main bodies of the first reinforcing piece and the second reinforcing piece, and with the first end lugs of the first reinforcing piece and the second reinforcing piece.

The corrugated metal sheet of the sealing membrane may be made of various materials, in particular of stainless steel, aluminum, nickel alloy steel with a very low expansion coefficient known as Invar®, or other metals or alloys.

According to one embodiment, the corrugated metal sheet layer has a first series of parallel corrugations protruding towards the inside of the tank, and also a second series of parallel corrugations protruding towards the inside of the tank and extending in a direction intersecting, in particular perpendicular to, the first series of corrugations, the corrugations of the first series of corrugations and the corrugations of the second series of corrugations intersecting at intersection points. Thanks to such a geometry, it is possible to obtain sufficient flexibility to absorb deformations in all directions of the median plane of the sealing membrane.

According to the requirements of the proposed application, a first batch of reinforcing pieces may be provided to reinforce each or some of the corrugations of the first series, and/or a second batch of reinforcing pieces may be provided to reinforce each or some of the corrugations of the second series. Reinforcing pieces of the first batch and/or of the second batch may be combined in various ways, in particular by sharing a stop element so that several reinforcing pieces of the first batch and/or the second batch are held jointly on the insulation barrier.

According to a corresponding embodiment, the thermal insulation barrier comprises a first groove aligned with the longitudinal direction of a corrugation of the first series and opening through the support surface, and also a second groove aligned with the longitudinal direction of a corrugation of the second series and opening through the support surface, the first groove and the second groove intersecting at an intersection between the corrugation of the first series and the corrugation of the second series, wherein said reinforcing piece belongs to a first batch of reinforcing pieces intended to reinforce the corrugations the first series of corrugations, and is engaged in the first groove at a position adjacent to the intersection between the first groove and the second groove, the first longitudinal end of the reinforcing piece of the first batch being turned towards the intersection between the first groove and the second groove, the tank also comprising a second batch of reinforcing pieces intended to reinforce the corrugations of the second series of corrugations, wherein a reinforcing piece of the second batch comprises a main body inserted in the corrugation of the second series between the sealing membrane and the support surface, the main body of the reinforcing piece of the second batch having an elongate form in the longitudinal direction of the corrugation of the second series and a base surface resting on the support surface, the reinforcing piece of the second batch comprising a retaining rib protruding relative to the base surface of the main body and engaged in the second groove of the thermal insulation barrier at a position adjacent to the intersection between the first groove and the second groove, the retaining rib forming a first end lug extending in the second groove beyond a first longitudinal end of the main body turned towards the intersection between the first groove and the second groove, and wherein the stop element is arranged on the support surface at the intersection between the first groove and the second groove, level with the first end lugs of the reinforcing piece of the first batch and of the reinforcing piece of the second batch, such that the stop element cooperates with the first longitudinal ends of the main bodies of the reinforcing piece of the first batch and of the reinforcing piece of the second batch, and with the first end lugs of the reinforcing piece of the first batch and of the reinforcing piece of the second batch.

According to a particular embodiment, a first and a second reinforcing piece of the first batch are engaged in the first groove on either side of the intersection of the first groove and the second groove, and a first and a second reinforcing piece of the second batch are engaged in the second groove on either side of the intersection between the first groove and the second groove, the stop element arranged at the intersection between the first groove and the second groove cooperating with the first longitudinal ends of the main bodies of the first and second reinforcing pieces of the first batch and of the first and second reinforcing pieces of the second batch, and with the first end lugs of the first and second reinforcing pieces of the first batch and of the first and second reinforcing pieces of the second batch.

According to an embodiment wherein the two series of corrugations have the same size and shape, the reinforcing pieces of the first batch and the reinforcing pieces of the second batch are identical.

Such a tank may form part of a land-based storage installation, for example for storage of LNG, or be installed in a floating structure, near the coast or in deep water, in particular a methane or ethane tanker, a floating storage and regasification unit (FSRU), an off-shore floating production and storage unit (FPSO) and similar.

According to one embodiment, a ship for the transport of a fluid comprises a double hull and a tank as mentioned above arranged in the double hull.

According to one embodiment, the invention also provides a method for loading or unloading of such a ship, wherein a fluid is conducted through insulated pipelines from or to a floating or land-based storage installation, to or from the ship's tank.

According to one embodiment, the invention also provides a transfer system for a fluid, the system comprising the above-mentioned ship, insulated pipelines arranged so as to connect the tank installed in the hull of the ship to a floating or land-based storage installation, and a pump for driving a fluid through the insulated pipelines from or to the floating or land-based storage installation, to or from the ship's tank.

BRIEF DESCRIPTION OF THE FIGURES

The invention will be better understood, and further aims, details, characteristics and advantages thereof will appear more clearly from the following description of several particular embodiments of the invention, given merely for illustrative purposes and without limitation, with reference to the attached drawings.

DETAILED DESCRIPTION OF EMBODIMENTS

Figure 1:
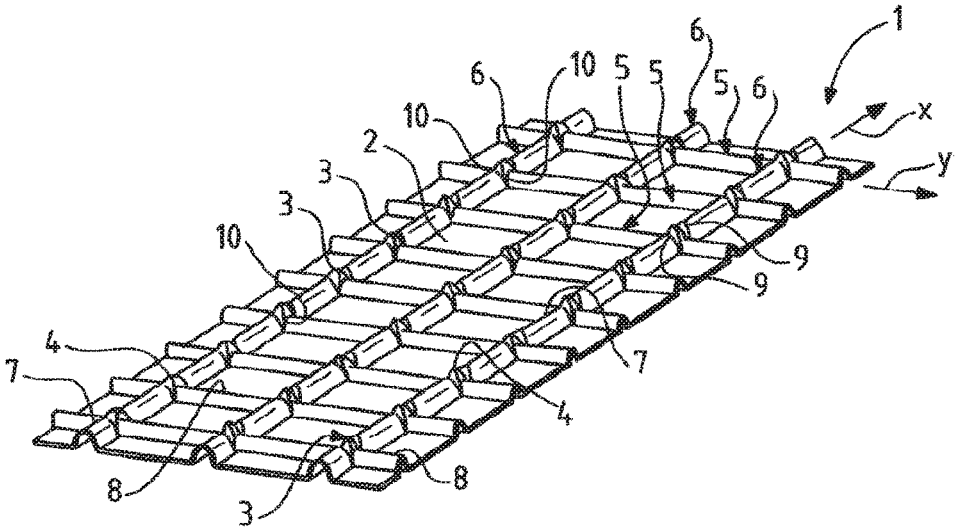
FIG.1 PRIOR ART
FIG. 1 is a perspective view of a corrugated metal plate known from the prior art, intended to produce a sealing membrane.

With reference to FIG. 1, a rectangular, corrugated metal plate 1 comprises, on its inner face 2, a first series of parallel corrugations known as low corrugations 5, extending in a direction y, and a second series of parallel corrugations called high corrugations 6, extending in a direction x. Directions x and y are perpendicular. The terms "high" and "low" here have a relative meaning and signify that the first series of corrugations 5 has a height which is lower than that of the second series of corrugations 6. At an intersection 3 between a low corrugation 5 and a high corrugation 6, the low corrugation 5 is discontinuous, i.e. interrupted by a fold 4 which extends the top ridge 7 of the high corrugation 6 and protrudes above the top ridge 8 of the low corrugation 5.

At a junction 3, the top ridge 7 of the high corrugation 6 comprises a pair of concave corrugations 9, the concavity of which is turned towards the inner face, and which are arranged on either side of the top ridge 8 of the low corrugation 5. A high corrugation 6 also comprises, at each junction 3, a concave reinforcement 10 on either side of the fold 4. A concave reinforcement 10 has its concavity turned towards the inner face 2 of the corrugated metal plate 1, and has a double curvature. A first curvature is around an axis perpendicular to the median plane of the corrugated metal plate 1. A second curvature is around axis x. The concave reinforcements 10 cause a flaring of the fold 4 in the direction of the bottom part of the fold 4, i.e. an undercut shape.

The high corrugations 6 are equidistant; they are three in number on the corrugated metal plate 1 shown, and the longitudinal edges of the corrugated plate 1 parallel to direction x are spaced by a half-wave interval relative to the nearest high corrugation 6. Similarly, the low corrugations 5 are equidistant; they are nine in number on the corrugated plate 1 shown, and the lateral edges of the corrugated metal plate 1 parallel to direction y are spaced by a half-wave interval relative to the nearest low corrugation 5. The wave interval of the high corrugations 6 and the wave interval of the low corrugations 5 may be equal or different.

For example, the low corrugations 5 have a height defined between the top ridge 8 and the surface of the corrugated metal plate 1 which is approximately equal to 36 mm, and a width at the base of the corrugation 5 of the order of 53 mm. For example, the high corrugations 5 have a defined height between the top ridge 7 and the surface of the corrugated metal plate 1 of the order of 54.5 mm, and a width at the base of the corrugation 6 of around 77 mm.

For example, the corrugated metal plate 1 is made of stainless steel or aluminum sheet, and has a thickness of around 1.2 mm and may be formed by deep drawing or folding. Other metals or alloys, and other thicknesses, are possible, where it is understood that a thickness of the corrugated metal plate 1 leads to an increase in its cost and generally increases the rigidity of its corrugations.

The corrugated metal plate 1 is ideal for forming a sealed membrane of a large capacity tank, for example for a cold liquid product, by assembly of multiple metal plates welded together along their edges. For this, at one of the two transverse edges and at one of the two longitudinal edges, the corrugated metal plate 1 has a deep drawn strip (not shown) which is offset upwards in the thickness direction relative to the plane of the remainder of the corrugated metal plate 1, in order to cover the edge of an adjacent corrugated metal plate.

Figure 2:
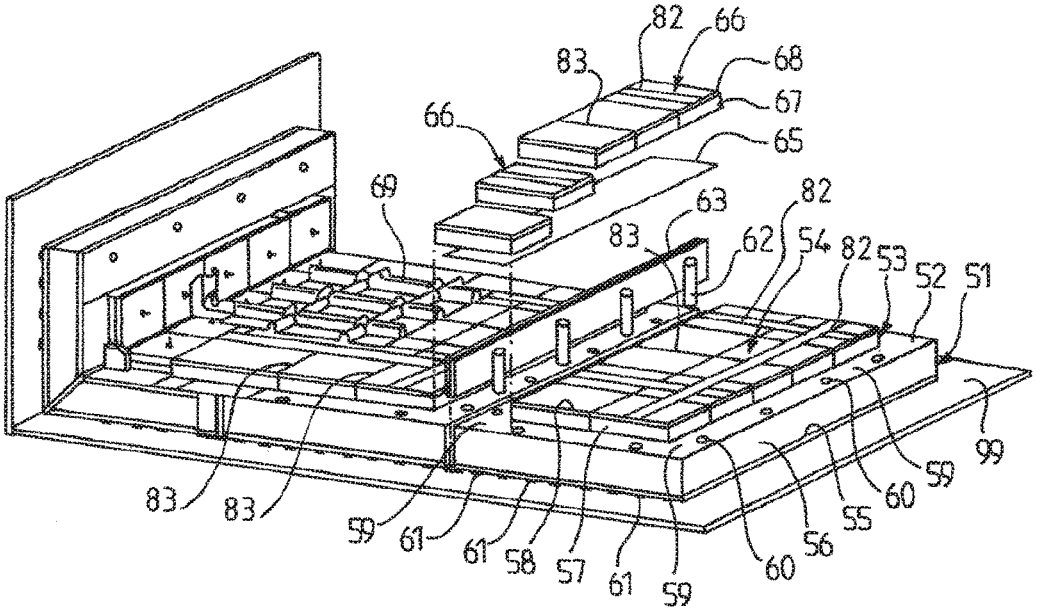
FIG.2 PRIOR ART
FIG. 2 is an exploded perspective view of a sealed and insulating tank wall known from the prior art, in which the corrugated metal plate from FIG. 1 may be used.

With reference to FIG. 2, we will now describe as an example a structure of a sealed and thermally insulating multilayer wall which comprises successively a primary sealing membrane intended to come into contact with the product contained in the tank, a primary insulation barrier, a secondary sealing membrane and a secondary insulation barrier, suitable for producing an LNG transport tank in a ship. The primary sealing membrane is made from corrugated metal plates 1.

Such a wall structure may be used to produce substantially all walls of a polyhedral tank. In this respect, in the description below, the terms "on", "above", "upper", and "high" generally refer to a position situated towards the inside of the tank and do not necessarily coincide with the concept of height in the terrestrial gravitational field. Similarly, the terms "under", "below", "lower" and "low" generally refer to a position situated towards the outside of the tank and do not necessarily coincide with the notion of depth in the terrestrial gravitational field.

The secondary insulation barrier, the secondary sealing membrane and the primary insulation barrier are made from prefabricated panels 54. The prefabricated panels 54 are attached to the carrier structure and are juxtaposed in a repeated pattern. Each panel 54 comprises an element of the secondary insulation barrier 51, an element of the secondary sealed barrier, and an element of the primary insulation barrier 53.

A panel 54 substantially has the shape of a rectangular parallelepiped. It consists of a first plywood panel 55 of 9 mm thickness, covered by a first thermal insulation layer 56, itself covered by a rigid sealed coating 52 of composite material known as rigid Triplex®, including a aluminum sheet of 0.07 mm thickness sandwiched between two layers of glass fibers impregnated with a polyamide resin. The sealed coating 52 is bonded to the thermal insulation layer 56, for example by means of a two-component polyurethane glue.

A second thermal insulation layer 57 is bonded to the sealed coating 52 and itself carries a second plywood panel 58 of 12 mm thickness. The subassembly 55-56 forms the secondary insulation barrier 51. The subassembly 57-58 constitutes the primary insulation barrier 53, and in plan view has a rectangular shape, the sides of which are parallel to those of the secondary insulation barrier element 51. The two insulation barrier elements in plan view have the shape of two rectangles with the same center. Element 53 leaves a peripheral edge surface 59 of the sealed coating 52 open all around the element 53. The sealed coating 52 constitutes a secondary sealing membrane element.

The panel 54 just described may be prefabricated to constitute an assembly, the various constituents of which are bonded together in the arrangement indicated above. This assembly therefore forms the secondary barriers and the primary insulation barrier. The thermal insulation layers 56 and 57 may be formed by a cellular plastic material such as a polyurethane foam. Preferably, glass fibers are encased in the polyurethane foam for reinforcement.

To ensure the fixing of the panels 54 to the carrier structure 99, bores 60 are provided which are regularly distributed over the two longitudinal edges of the panel in order to cooperate with pins fixed to the carrier structure 99 according to the prior art.

The carrier structure 99, in particular in the case of a ship, has gaps relative to the theoretical surface intended for the carrier structure simply because of production tolerances. In the known fashion, these gaps are compensated by resting the panels 54 against the carrier structure via rings of polymerizable resin 61, which, starting from an imperfect carrier structure surface, create a cladding formed by adjacent panels 54 having second plates 58, which as a whole define a surface with practically no gaps relative to the theoretically desired surface.

The bores 60 are sealed by inserting plugs of thermally insulating material 62, these plugs terminating flush with the first thermal insulation layer 56 of the panel 54. Also, a thermally insulating material 63 may be inserted in the gaps separating the elements 51 of adjacent panels 54, which material is formed for example from a sheet of plastic foam or glass wool inserted in the gap.

To create a continuous secondary sealing membrane, a flexible sealing strip 65 is placed on the adjacent peripheral edges 59 of two adjacent panels 54, and the sealing strip 65 is glued to the peripheral edges 59 so as to seal the perforations situated at each bore 60 and to cover the gap between the two panels 54. The sealing strip 65 consists of a composite material called flexible Triplex® comprising three layers: the two outer layers are glass fiber matting and the intermediate layer is a thin metal sheet, for example aluminum sheet with a thickness of around 0.1 mm. This metallic sheet ensures the continuity of the secondary sealing membrane. Its bending flexibility, because of the flexible nature of the bond between the aluminum sheet and the glass fibers, enables it to follow the deformations of the panels 54 due to deformation of the hull in the swell or the chilling of the tank. The phrase "bending flexibility" means the capacity of the material to bend in order to form waves, without breaking.

A recessed zone, situated at the level of the peripheral edges 59, is situated between the elements 53 of two adjacent panels 54, and the depth of this recession is substantially equal to the thickness of the primary insulation barrier. These recessed zones are filled by installing insulating blocks 66, each composed of a thermal insulation layer 67 covered by a rigid plywood panel 68 on an upper surface of the insulating block 66.

The insulating blocks 66 have dimensions such that they completely fill the zone situated above the peripheral edges 59 of two adjacent panels 54. The insulating blocks 66 are bonded onto the sealing strips 65. After installation, the panel 68 ensures a relative continuity between the plates 58 of two adjacent panels 54 for supporting the primary sealing membrane.

These insulating blocks 66 have a width equal to the distance between two elements 53 of two adjacent panels 54, and may have a greater or lesser length. A reduced length allows, where required, easier installation in the case of a slight misalignment of two adjacent panels 54. The blocks 66 are bonded to the sealing strip 65 and rest thereon.

On FIG. 1, the insulating blocks 66, the sealing strip 65 and the thermal insulation materials 62 and 63 are shown in exploded form and thus appear above their actual position in the tank wall in the final assembled state. The final position of the insulating block 66 is best shown on FIG. 3 which will be described below.

The primary sealing membrane 69 is formed from a layer of corrugated metal with two series of intersecting corrugations, giving it sufficient flexibility in both directions of the plane of the tank wall, and obtained by assembling multiple juxtaposed corrugated metal plates 1. The plywood panels 58 and 68 carry metal anchoring strips 82 fixed thereon by any suitable means, for example riveted, which allow the edges of the corrugated metal plates 1 to be welded in order to anchor the primary sealing membrane 69 to the insulation barrier. In view of the position of the metal anchoring strips 82, the edges of the corrugated metal plates 1 are offset in both directions of the plane relative to the edges of the elements of the primary insulation barrier 53 and the insulating blocks 66.

Furthermore, the gaps between the elements of the primary insulation barrier 53 and the insulating blocks 66 are each aligned with the corrugations 5, 6 of the corrugated metal plates 1. To obtain this alignment, the elements of the primary insulation barrier 53 and the insulating blocks 66 are dimensioned in integral multiples of wave intervals of the corrugated metal plates 1, and the offset between a metal anchoring strip 82 and the adjacent edge of the element of the primary insulation barrier 53, or of the insulating block 66 carrying said metallic anchoring strip 82, is equal to a half-wave interval.

Also, the elements of the primary insulation barrier 53 and the insulating blocks 66 also comprise stress-relief slots 83 which are oriented parallel to the sides of the panels 54 and also aligned with the corrugations 5 and 6 of the corrugated metal plates 1. For this, the stress-relief slots 83 in each direction are equidistant by a distance equal to a wave interval, and also spaced by an integral multiple of the wave interval relative to the edges of the elements of the primary insulation barrier 53 and the insulating blocks 66.

The stress-relief slots 83 serve to prevent the cracking of the cellular foam when the tank wall is chilled, while preserving the deformation capacity of the corrugations of the corrugated metal plates 1. They are cut into a portion of the thickness of the elements of the primary insulation barrier 53 and the insulating blocks 66 and open onto the upper surface.

Thus, the assembly of the stress-relief slots 83 and the gaps 84 (FIG. 3) between the elements of the primary insulation barrier 53 and the insulating blocks 66, constitutes a periodic network of rectilinear grooves which has a rectangular mesh or a square mesh if the wave interval is the same in both directions x and y, and which is aligned with the periodic network formed by the high corrugations 6 and the low corrugations 5 of the primary sealing membrane 69.

This groove network may be used to fix the reinforcing pieces 15 (FIG. 3), as will now be explained with reference to FIGS. 3 to 19, on which elements identical or similar to those of FIG. 2 carry the same reference numerals and will not be described again. Insofar as the reinforcing pieces function substantially in the same way when fixed to the stress-relief slots 83 and to the gaps 84, the expression "groove 83, 84" will be used below to describe embodiments in which the groove may be formed either by a stress-relief slot 83 or by a gap 84.

Similarly, insofar as the reinforcing pieces function substantially in the same way when fixed to the elements of the primary insulation barrier 53 or to the insulating blocks 66, the term "upper plate 58, 68" will be used below to describe embodiments in which the upper surface of the primary insulation barrier may be formed either by the plywood panel 58 of an element of the primary insulation barrier 53 or by the plywood panel 68 of an insulating block 66.

Figure 3:
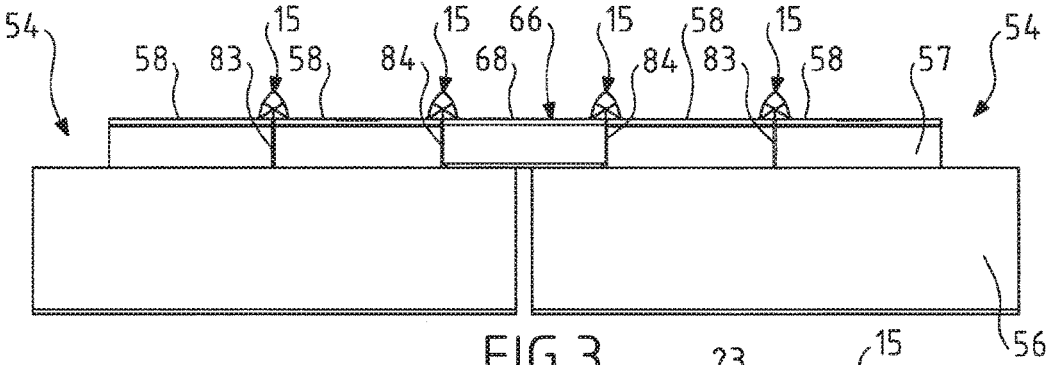
FIG. 3 is a flat cross-sectional view of a tank wall similar to that of FIG. 2, in which reinforcing pieces are used.

FIG. 3 is a sectional view of the tank wall of FIG. 2 in which the reinforcing pieces 15 of elongate form, here viewed in cross-section, are fixed to the primary insulation barrier at the stress-relief slots 83 and the gaps 84, in order to reinforce the corrugations of the primary membrane, which is omitted here.

Figure 4:
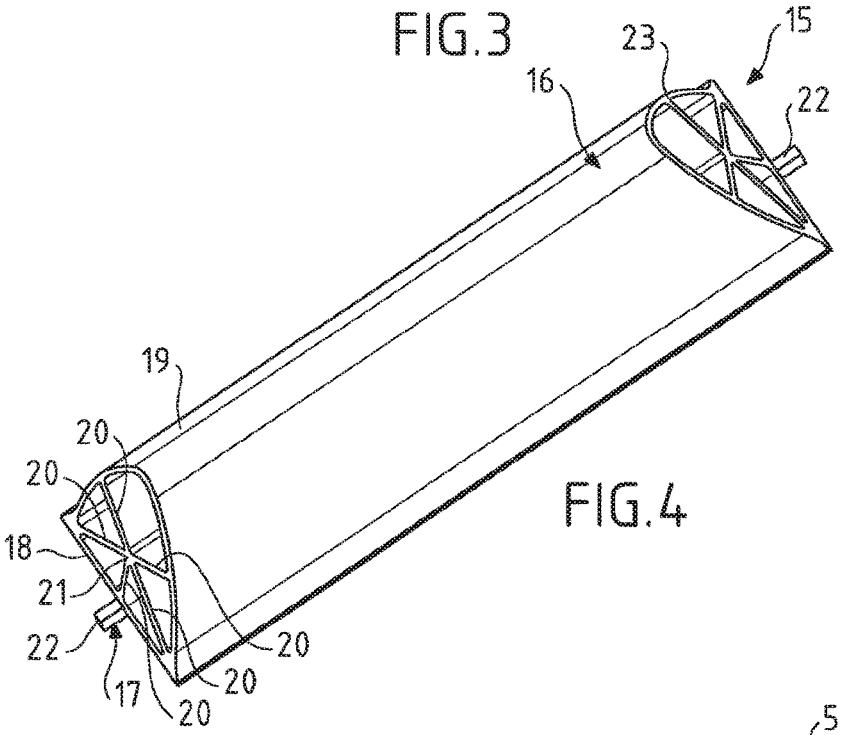
FIG. 4 is a perspective elevational view of a reinforcing piece used in the tank wall of FIG. 3.

The reinforcing piece 15 as a whole is shown in perspective on FIG. 4. It comprises a hollow envelope 16 which forms the main body of the reinforcing piece 15, and a retaining rib 17 protruding towards the outside perpendicularly to the base wall 18 of the hollow envelope 16 and positioned halfway across the width of this base wall 18. The base wall 18 is flat to rest on the upper plates 58, 68 of the primary insulation barrier. The retaining rib 17 has a rectangular cross-section to engage in the grooves 83, 84 of the primary insulation barrier.

The hollow envelope 16 has an upper wall 19 of semi-elliptical cross-section which rises in a dome above the base wall 18 in order to follow the form of the corrugation in which it is inserted. Ribs 20 of fine thickness are arranged inside the hollow envelope 16 to reinforce its rigidity, for example five ribs arranged in a star pattern around a central hub 21. The reinforcing piece 15 thus has a profiled form of constant cross-section over its entire length, apart from the two longitudinal ends which have two unique features:

- the retaining rib 17 is extended beyond the base wall 18 of the hollow envelope 16 so as to form two end lugs 22;
- the longitudinal ends 23 of the hollow envelope 16 are cut in a plane which is inclined relative to the longitudinal axis of the reinforcing piece by an inclination angle of less than 30°, for example around 25°. This inclination is best seen on FIG. 5 which is a top view.

The reinforcing piece 15 may be made in any desired length. The length of the hollow envelope 16 is preferably substantially equal to the wave interval of the corrugations which intersect the corrugation in which the reinforcing piece 15 is inserted. More precisely, for reinforcing pieces intended to reinforce the high corrugations 6, the length of the hollow envelope 16 at the top is for example equal to the length of the portion of the high corrugations 16 which has a uniform cross-section between two intersections. This portion of uniform cross-section stops when the high corrugation 6 has a slight lateral constriction marking the start of the intersection zone, the geometry of which is complex as explained above. Also, the inclination of the longitudinal end surfaces 23 of the hollow envelope 16 corresponds substantially to the inclination of this lateral constriction, such that the hollow envelope 16 comes as close as possible to the intersection zone in order to optimize support of the corrugation.

Figure 5:
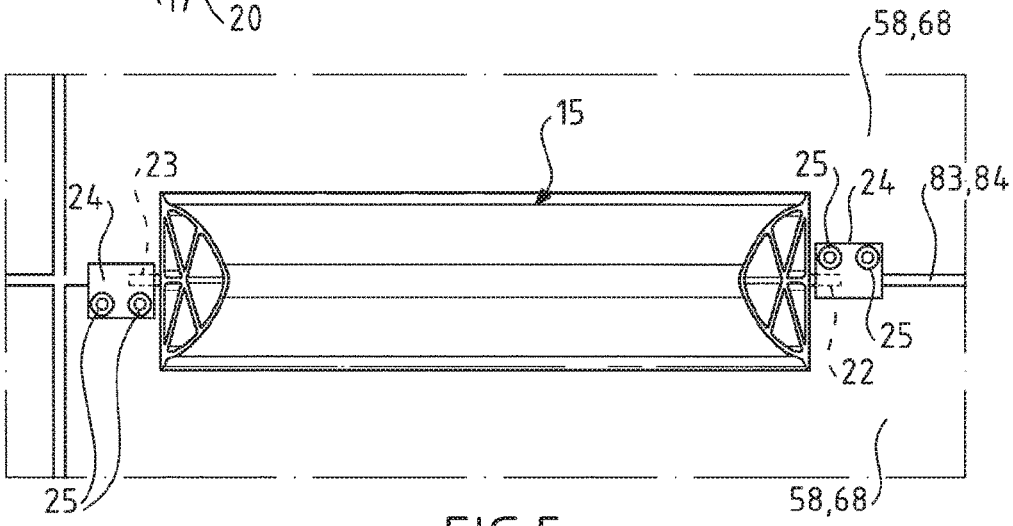
FIG. 5 is a top view of a zone of the tank wall FIG. 3, showing a stop element according to a first embodiment.

FIG. 5 shows the reinforcing piece 15 fixed to the insulating mass. For this, according to a first embodiment, two stop plates 24 are fixed to the upper plates 58, 68 of the primary insulation barrier at the two ends of the reinforcing piece 15, so as to straddle the groove 83, 84 in which the rib 17 is housed, level with each of the two end lugs 22. More precisely, the stop plate 24 has a rectangular form with two fixing holes 25 to receive a fastening such as a rivet, screw, clip, nail or other. The two fixing holes 25 are made over a portion of the stop plate 24 which lies on the same side of the groove 83, 84. Thus the possible expansion of the groove 83, 84 during the life of the tank is not liable to cause a stress in the stop plate 84. In the example shown, the two stop plates 24 are fixed to two different upper plates 58, 68 situated on either side of the groove 83, 84, and each time have an overhanging part which straddles the groove to extend over the upper plate 58, 68 situated on the other side of the groove.

Thanks to this arrangement, the reinforcing piece 15 is fixed securely to the insulating mass. The reinforcing piece 15 may be installed in the following order: firstly, the retaining rib 17 is inserted in the groove 83, 84 until the base wall 18 rests on the two upper plates 58, 68 situated on either side of the groove 83, 84. The retaining rib 17 substantially fixes the reinforcing piece 15 in the lateral direction by means of a mounting play, the amount of which may be greater or lesser, but allows the reinforcing piece 15 to slide longitudinally along the groove to a suitable position in particular relative to the nearest intersection. The stop plates 24 may then be fixed to the upper plates 58, 68 so as to fix the reinforcing piece 15 substantially in the longitudinal direction and in the vertical direction (i.e. thickness direction of the wall) by means of mounting play, the amount of which may be greater or lesser.

Alternatively, it is also possible to fix one of the two stop plates 84 firstly, in order to provide a positional reference to facilitate the positioning of the reinforcing piece 15.

Figure 6:
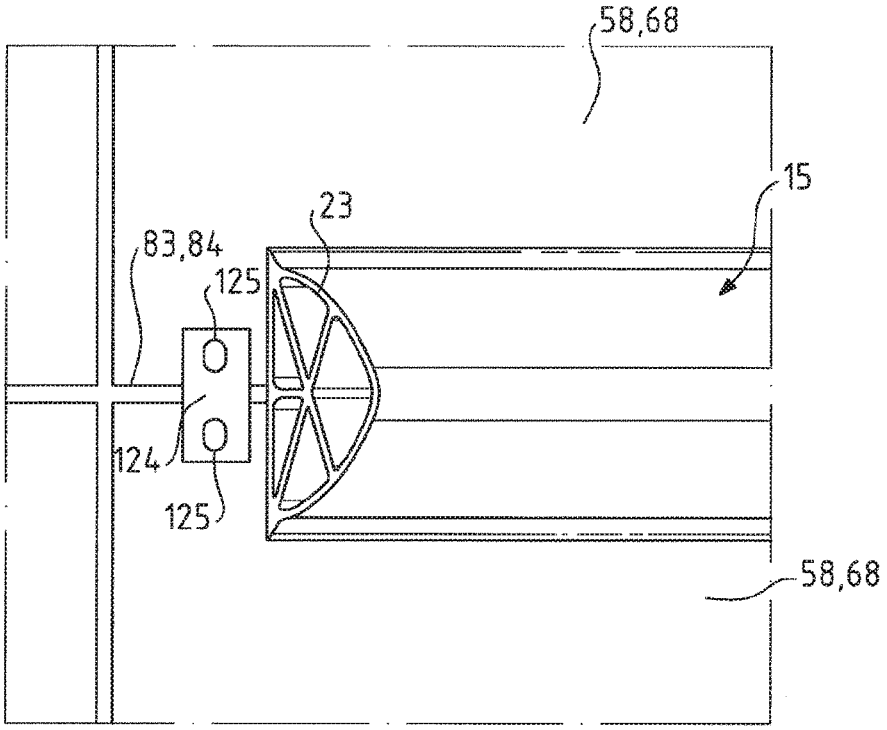
FIG. 6 is a view similar to FIG. 5 on slightly enlarged scale, showing a stop element according to a second embodiment.

According to the second embodiment shown on FIG. 6, a stop plate 124 is used instead of one or each stop plate 24. The unique feature of the stop plate 124 is that it can be fixed simultaneously to two different upper plates 58, 68 situated on either side of the groove 83, 84. For this, the two fixing holes 125 of the stop plate 124 preferably have an oblong form in the direction transversely to the groove 83, 84 receiving the retaining rib 17, so as to be able to absorb changes in the width of the groove 83, 84 over the life of the tank. For the rest, the stop plate 124 is used like the stop plate 24.

Figure 7:
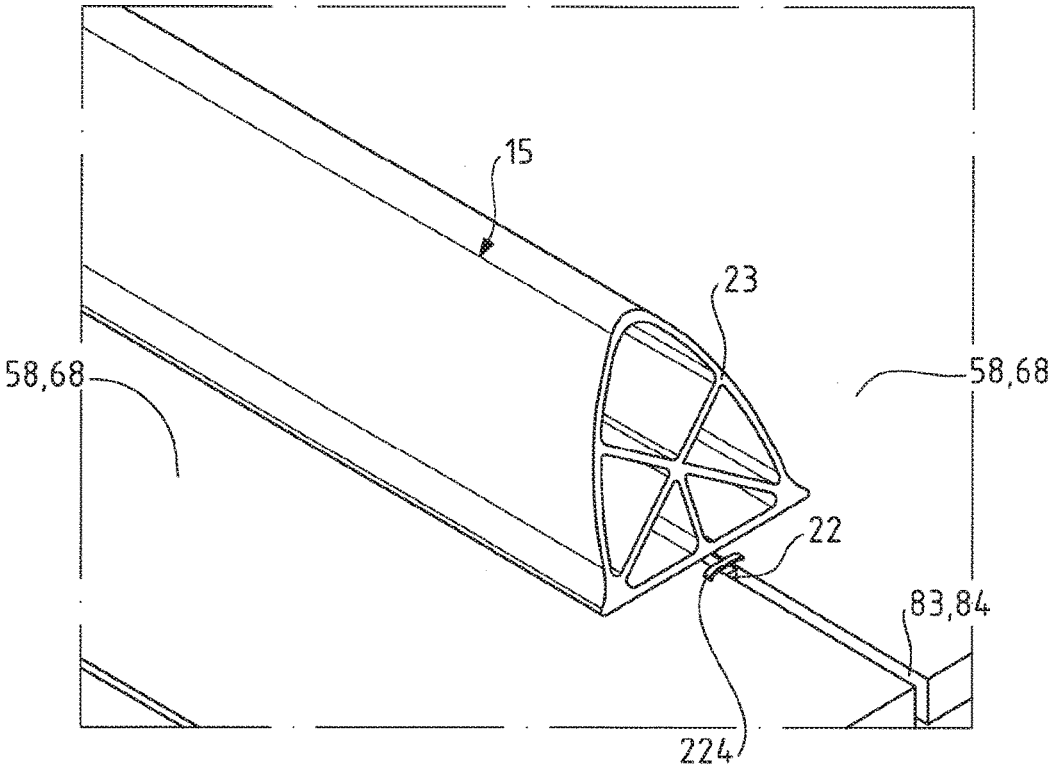
FIG. 7 is a perspective view of a zone of the tank wall of FIG. 3 in which the stop element is a clip.
Figure 8:
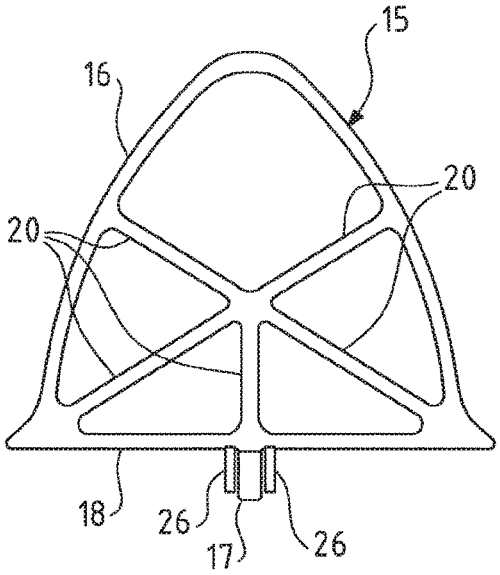
FIG. 8 is a cross-sectional view of the reinforcing piece of FIG. 4 equipped with thickness shims.

According to a third embodiment shown in FIG. 7, a clip 224 is used instead of one or each stop plate 24. The clip 224 is fixed spanning the groove 83, 84 and has two tips which are forcibly pressed into the two different upper plates 58, 68 situated on either side of the groove 83, 86, while its central portion straddles the groove 83, 84 above the end lug 22. Otherwise, the clip 224 is used like the stop plate 24.

The grooves 83, 84 and in particular the gaps 84 are likely to have variations in width within a tank wall, because of installation tolerances and accumulations of such tolerances inherent in these modular constructions. Thus it may be suitable to adapt the thickness of the retaining rib 17 to a particular groove width, in order to limit the lateral play of the reinforcing piece 15 in the groove without having to produce reinforcing pieces in a large number of different dimensions, which would complicate the supply and stock-holding procedure. For this, as shown on FIG. 8, it is possible to fit thickness shims 26, in the form of elongated flat strips, on one or preferably both sides of the retaining rib 17. The thickness shims 26 may be made of metal or of the same material as the reinforcing piece 15 and be fixed thereto by any suitable means, for example by screwing, gluing, riveting, interlocking forms or other. Such thickness shims 26 can easily be supplied in different thicknesses to absorb tolerances of greater or lesser amount.

Figure 9:
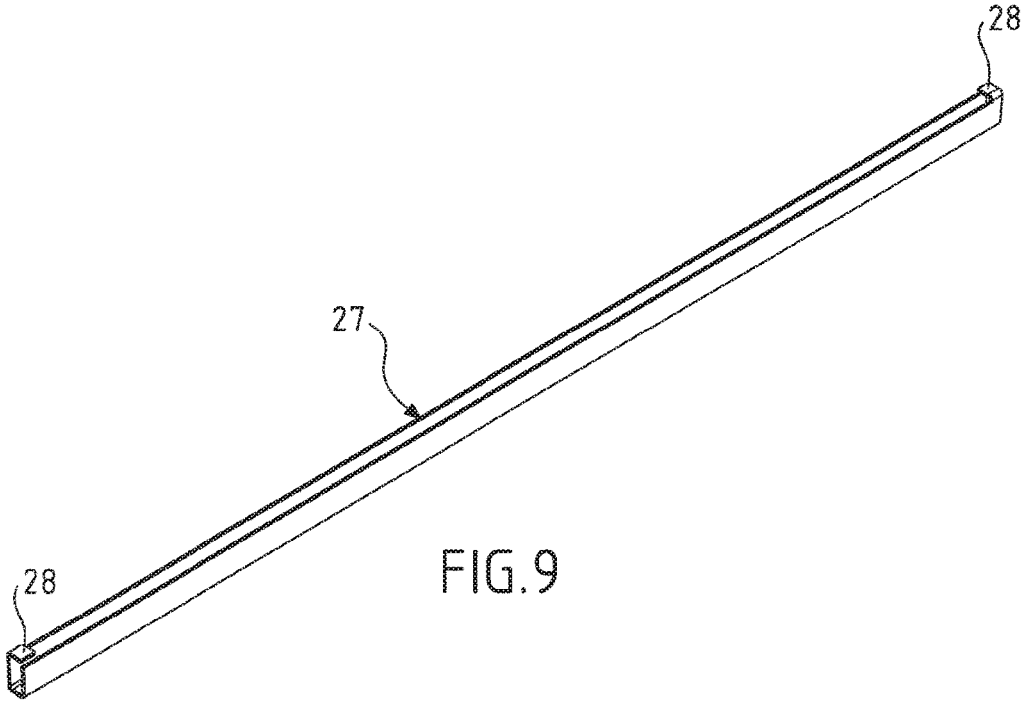
FIG. 9 is a perspective view of a profiled body which may serve as a thickness shim.
Figure 10:
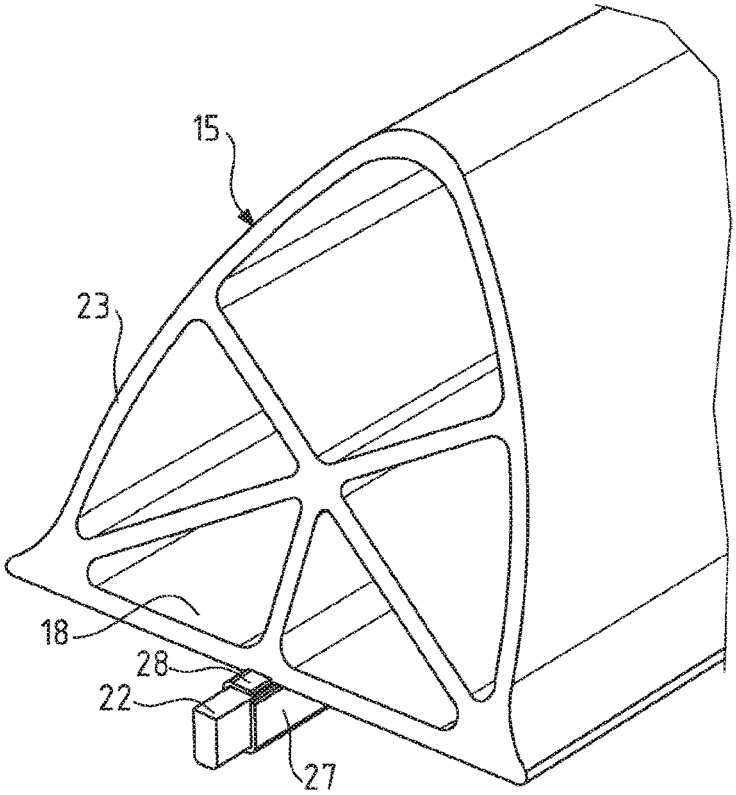
FIG. 10 is a partial, enlarged, perspective view of the reinforcing piece of FIG. 4 equipped with the profiled body of FIG. 9.

FIGS. 9 and 10 show an embodiment in which the thickness shims are provided in the form of a profiled body 27, for example metallic, with substantially the same length as the retaining rib 17 including the end lugs 22. The cross-section of the profiled body 27 has a U-shape, the open side of which is turned towards the base wall 18 of the hollow envelope 16 while the profiled body 27 surrounds the retaining rib 17 on three sides. At the two longitudinal ends, the profiled body 27 has a fixing tab 28 which may be folded by plastic deformation over each end lug 22, in order to permanently fix the profiled body 27 to the reinforcing piece 15. The profiled body 27 increases the thickness of the retaining rib 17, in the same way as the thickness shims 26.

Figure 11:
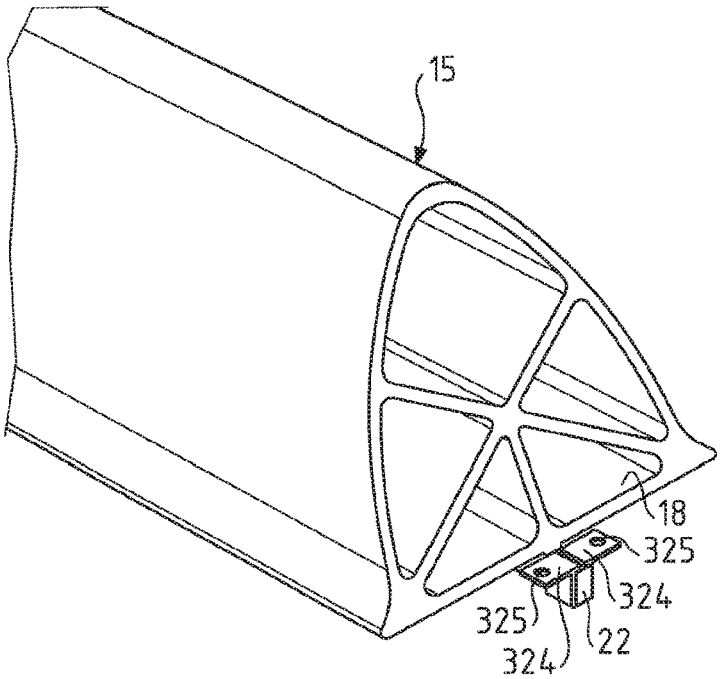
FIG. 11 is a partial perspective view of the reinforcing piece of FIG. 4 equipped with a profiled body which may serve as a thickness shim according to another embodiment.
Figure 12:
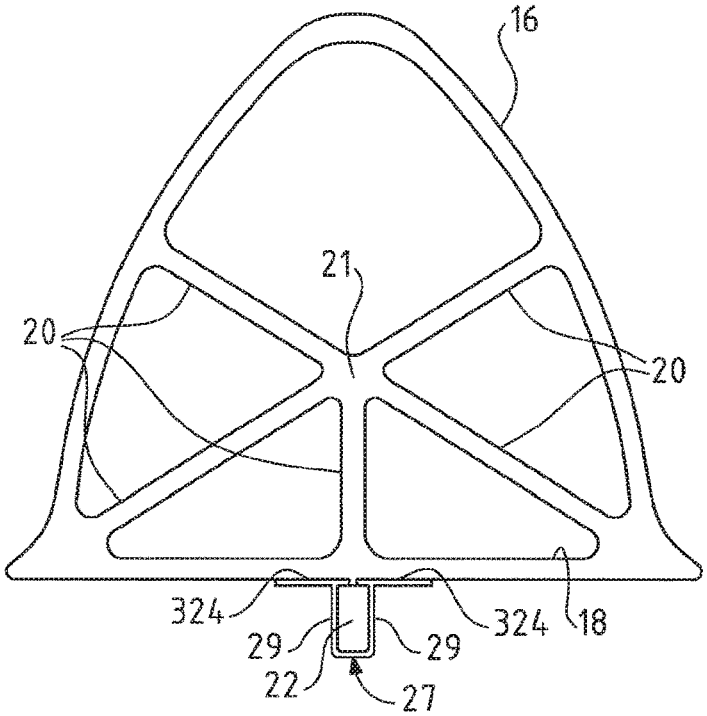
FIG. 12 is a front view of the reinforcing piece of FIG. 11.
Figure 13:
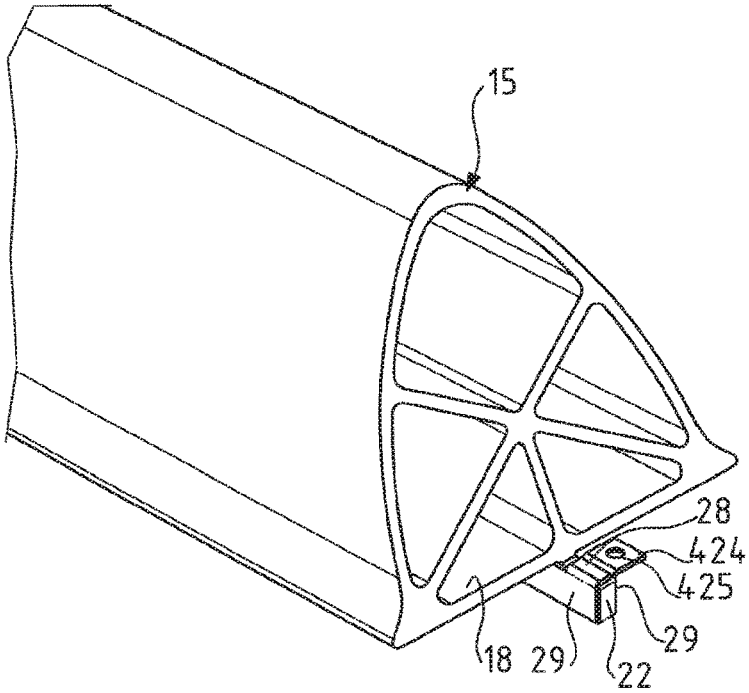
FIG. 13 is a partial perspective view of the reinforcing piece of FIG. 4 equipped with a profiled body which may serve as a thickness shim according to another embodiment.

FIGS. 11 to 13 show variant embodiments of the profiled body 27 in which stop plates are integrated in the profiled body 27 so as also to allow fixing of the reinforcing piece 15 to the insulating mass. Elements identical or similar to those in FIGS. 9 and 10 carry the same reference numeral.

On FIGS. 11 and 12, the fixing tab 28 is replaced by two fixing plates 324 which are each fastened to a lateral arm 29 of the U-shaped profiled body 27. More precisely, the stop plate 324 is formed integrally with or welded to the upper end of the lateral arm 29 and extends laterally on either side of the lateral arm 29, with a short portion which covers the upper surface of the end lug 22 and the fixing tab 28, and a longer portion which extends away from the end lug 22 and covers the upper plate 58, 68 adjoining the groove 83, 84. The longer portion comprises a fixing hole 325 allowing engagement of a fastening for fixing the stop plate 324 to the upper plate 58, 68.

On FIG. 13, the fixing plate 28, which is integral with a first lateral arm 29 of the U-shaped profiled body 27, is retained while a single stop plate 424 is provided, which is integral with the second lateral arm 29 of the U-shaped profiled body 27 in the alignment of the fixing tab 28. The stop plate 424 protrudes laterally, extending away from the end lug 22, and covers an upper plate 58, 68 adjoining the groove 83, 84, and comprises a fixing hole 425 allowing engagement of a fastening to fix the stop plate 424 to the upper plate 58, 68.

Figure 14:
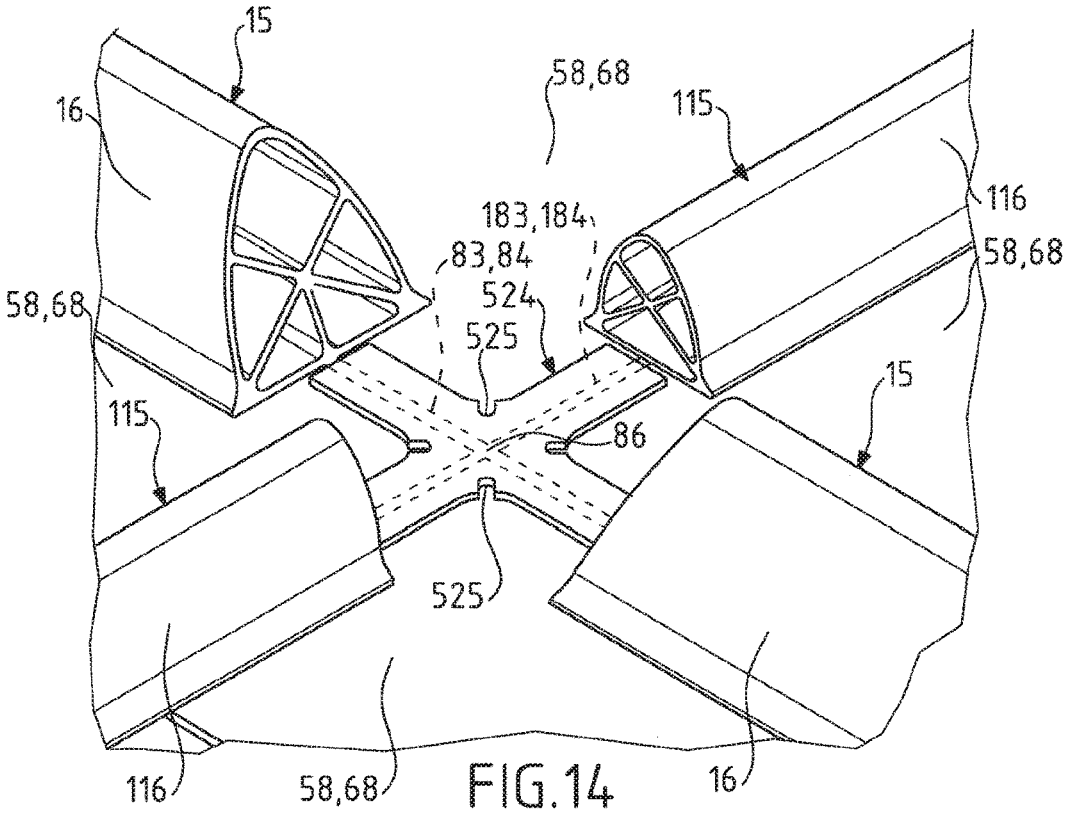
FIG. 14 is a view similar to FIG. 5, showing a stop element according to another embodiment, cooperating with four adjacent reinforcing pieces.
Figure 15:
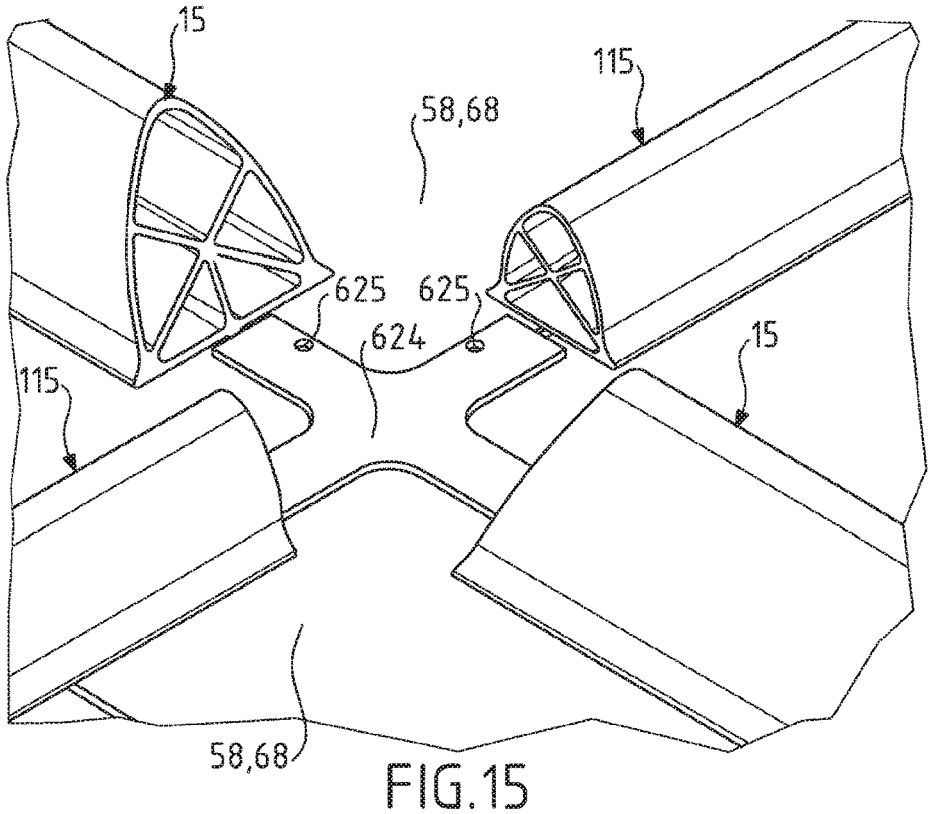
FIG. 15 is a view similar to FIG. 14 showing a variant of the stop element.
Figure 16:
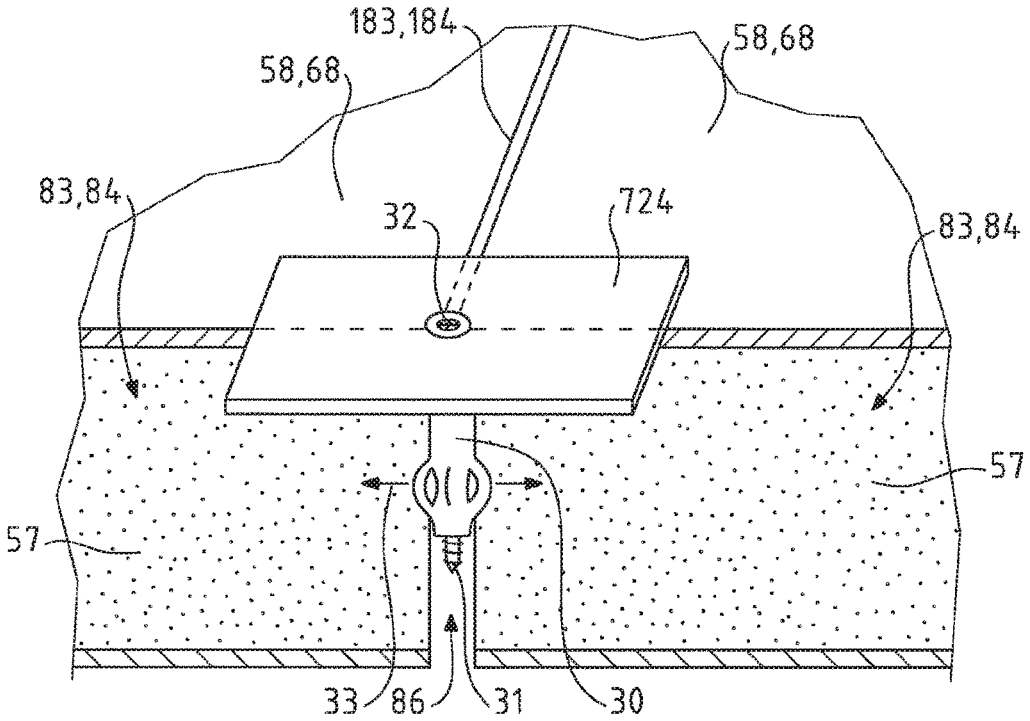
FIG. 16 is a perspective cross-sectional view of a zone of the tank wall showing another variant of the stop element.

With reference to FIGS. 14 to 16, we will now describe embodiments of the tank wall in which a stop plate is arranged at the intersection between two grooves in order to cooperate with several reinforcing pieces.

On FIG. 14, a first groove 83, 84, drawn in dotted lines, corresponds to the route of a high corrugation 6 (not shown, see FIG. 1), while a second groove 183, 184, drawn in dotted lines, corresponds to the route of a low corrugation 5 (not shown, see FIG. 1) which intersects the high corrugation 6. The grooves 83, 84 and 183, 184 have an intersection 86 situated level with the junction 3 (not shown, see FIG. 1) between the low corrugation 5 and the high corrugation 6.

Two reinforcing pieces 15 adapted to the shape of the high corrugation 6 are arranged on the first groove 83, 84 on either side of the intersection 86. Similarly, two reinforcing pieces 115 adapted to the form of the low corrugation 5 are arranged on the second groove 183, 184 on either side of the intersection 86. The reinforcing piece 115 is similar to the reinforcing piece 15 described above and differs only by a smaller cross-section and a smaller number of inner ribs.

The ends of the four reinforcing pieces 15 and 115 turned towards the intersection 86 have a certain distance from the intersection 86 of the grooves, since they do not engage in the intersection zone of the corrugated metal plate 1, as explained above. The portion of the first groove 83, 84 which extends between the hollow envelopes 16 of the two reinforcing pieces 15 on one side, and the portion of the second groove 183, 184 which extends between the hollow envelopes 116 of the two reinforcing pieces 115 on the other, are covered by a single, generally cruciform stop plate 524. Each of the four arms of the cruciform stop plate 524 fixes the longitudinal end of the reinforcing piece 15 or 115 toward which it extends, in the same way as the above-mentioned stop plates 24.

The stop plate 524 may be fixed to the insulation barrier in various ways. For example, fixing holes 525 may be arranged at different locations in the stop plate 524 for engagement of fastenings. Thus the stop plate 524 allows four reinforcing pieces 15 and 115 to be anchored to the insulating mass simultaneously.

On FIG. 14, four fixing holes 525 are arranged in the four corners formed by the four arms of the stop plate 524, such that the stop plate 524 can be fastened to each of the four upper plates 58, 68 situated on either side of the first groove 83, 84, and on either side of the second groove 183, 184, via a respective fastening. The fixing holes 525 have an open side on the edge of the stop plate 524 which allows a sliding play to be created between a fastening and the stop plate 524 in the case of expansion of one or more grooves.

In a modified version, only two diametrically opposed holes may be used, instead of the four fixing holes 525.

In the embodiment of FIG. 15, the stop plate 624 differs from the stop plate 524 only by the position of the fixing holes 625, which are for example two in number and are arranged along only one of the four corners formed by the four arms of the stop plate 624. Thus the stop plate 624 is fastened only to one of the four upper plates 58, 68 situated on either side of the first groove 83, 84, and on either side of the second groove 183, 184. As a result, the stop plate 624 and the insulation barrier to which it is fixed may slide relative to each other in the case of expansion of one or more grooves, without stresses being generated in the stop plate 624 or in the insulation barrier.

FIG. 16 is a sectional view of the insulation barrier in a cross-sectional plane aligned on the groove 83, 84. The reinforcing pieces 15 and 115 are omitted for clarity. Here, the stop plate 724 is anchored to the insulating mass by means of a peg 30, a screw with a head 32 accessible on the upper face of the stop plate 724, and a threaded body 31 engaged in the peg 30 below the stop plate 724. Furthermore, this anchoring is compatible with any shape of stop plate, for example a rectangular shape like the stop plate 724 shown, or a cross shape like the stop plates 524 and 624.

During use, the stop plate 724 is placed, as shown in FIGS. 14 and 15, level with the intersection 86 between the grooves such that in the initial state, the peg engages freely or with a slight friction in the space of the intersection 86. Turning the head of the screw 32 with a screwdriver then allows expansion of the peg 30, as indicated by arrows 33, until this is firmly anchored in the insulating mass, locally compressing the material of the thermal insulation layer 57.

It will be understood that if the reinforcing pieces 15 and 115 have lengths adapted to the wave interval, stop plates 524, 624 or 724 may be used at each end of each of the reinforcing pieces 15 and 115, which divides the total number of stop plates necessary by four, relative to the embodiments in FIGS. 5 to 7.

Figure 17:
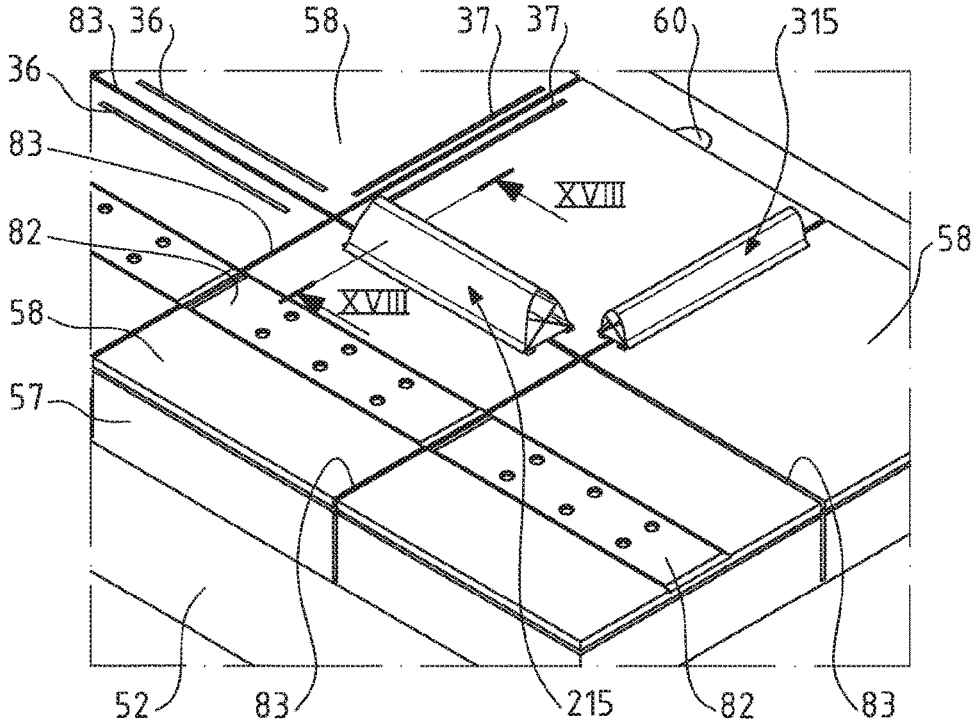
FIG. 17 is a partial perspective view of a zone of the tank wall of FIG. 3 showing reinforcing pieces according to another embodiment.
Figure 18:
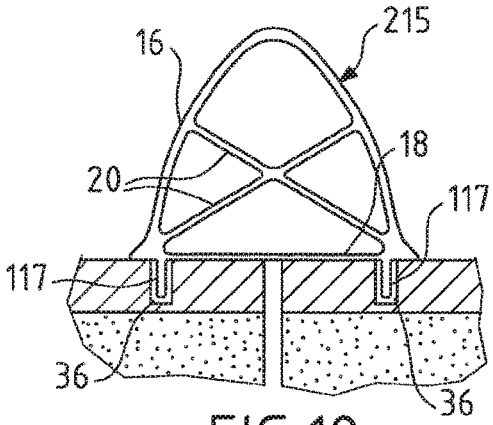
FIG. 18 is a partial view of the tank wall according to FIG. 16 in a cross-section along axis XVIII-XVIII.
Figure 19:
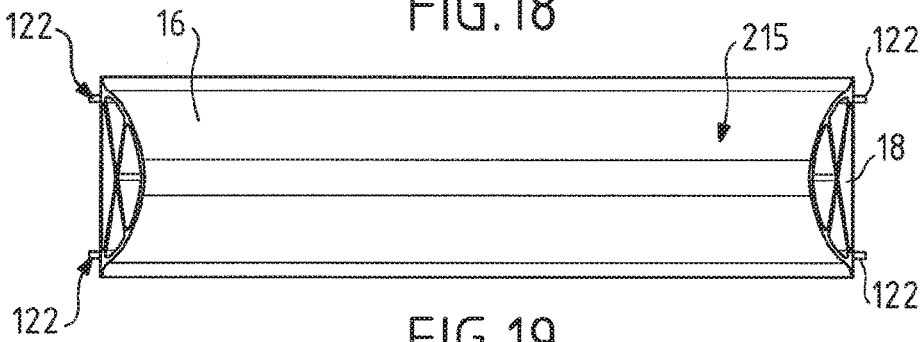
FIG. 19 is a top view of the reinforcing piece of FIG. 17.

With reference to FIGS. 17 to 19, we will now describe the reinforcing pieces in another embodiment, wherein these comprise two retaining ribs. As shown on FIG. 19 which depicts the reinforcing piece 215 from above, the hollow envelope 16 remains unchanged but the base wall 18 here carries two retaining ribs 117, which are arranged on either side of the median longitudinal axis of the hollow envelope 16 and which each extend beyond the two sides of the hollow envelope 16 to form four end lugs 122.

FIG. 17 is a partial perspective view of a tank wall similar to that of FIG. 2, here carrying a reinforcing piece 215 adapted to a high corrugation 6, and a reinforcing piece 315 adapted to a low corrugation 5. The reinforcing pieces 215 and 315 may be arranged in the same way as the reinforcing pieces 15 and 115 described above, to reinforce respectively a high corrugation 6 and a low corrugation 5 of the primary sealed membrane. However, supplementary grooves are necessary in the underlying insulation barrier, namely two grooves 36 arranged on either side of the stress-relief slot 83 on which the reinforcing piece 215 is arranged, and two grooves 37 arranged on either side of the stress-relief slot 83 on which the reinforcing piece 315 is arranged. The two grooves 36 are best seen in the cross-sectional view of FIG. 18. The grooves 37 may be produced similarly, with a smaller spacing since the reinforcing piece 315 is narrower than the reinforcing piece 215.

Thanks to its two retaining ribs 117, the reinforcing piece 215 or 315 is highly stable in the lateral direction, which is particularly advantageous for tolerating asymmetric pressure forces such as are frequently produced by the sloshing of an LNG cargo at sea.

The reinforcing pieces 215 and 315 may be fixed to the insulation barrier by means similar to those described with reference to the preceding figures. In particular, all forms of stop plate described above are suitable for these embodiments, either by doubling the number of stop plates or by widening the stop plates to cover jointly the two end lugs 122 situated on the same side of the reinforcing piece 215 or 315. In a variant embodiment, one of the two end lugs 122 situated on a same side of the reinforcing piece 215 or 315 is no longer stopped, which avoids the need to use two stop plates or to widen the stop plate. Thus there is no need to stop one of the two end lugs 122 at each of the two ends of the reinforcing piece 215 or 315 (i.e. two lugs stopped) or at just one of the two ends of the reinforcing piece 215 or 315 (i.e. three lugs stopped in total).

In a variant (not shown), the reinforcing piece 15 is modified in that the retaining rib 17 has a cross-section in the form of an inverted T, the horizontal bar being arranged at the lower end of the retaining rib. This embodiment is naturally compatible with an insulation barrier, the grooves of which also have cross-sections adapted to receive the horizontal bar of the T. Although installation is slightly complicated by the need to insert the reinforcing piece in the longitudinal direction of the groove, this embodiment reinforces the retention of the reinforcing piece against detachment in the vertical direction, and against lateral pivoting.

Stop elements attached to the thermal insulation barrier have been described above which are produced with flat shapes of low thickness, which have the advantage of requiring little space, in particular when the stop element must be situated below a junction 3 of the sealing membrane. However, it will be noted that the function described above for retaining the reinforcing pieces on the thermal insulation barrier may be obtained with stop elements of other shapes.

Although we have essentially described the reinforcing pieces above in relation to the primary insulation barrier of an insulating mass sold by the applicant under the name Mark III, such reinforcing pieces may be used with insulating masses produced in other forms, for example in the form of juxtaposed parallelepipedic modules. Another embodiment of insulating panels with which the reinforcing pieces may be used is thus described in WO-A-2014125186.

Similarly, such reinforcing pieces could be used to reinforce a secondary sealing membrane.

In a simplified embodiment, the multilayer structure of the tank wall is limited to a primary sealing membrane and the primary insulation barrier, while all secondary elements are omitted. In another simplified embodiment, the primary membrane 69 comprises merely a single series of parallel corrugations, while the low corrugations 5 and the corresponding reinforcing pieces are omitted.

The tank wall structures described above may be used in various types of installation, in particular in a land-based installation or a floating installation such as a methane tanker or similar.

Figure 20:
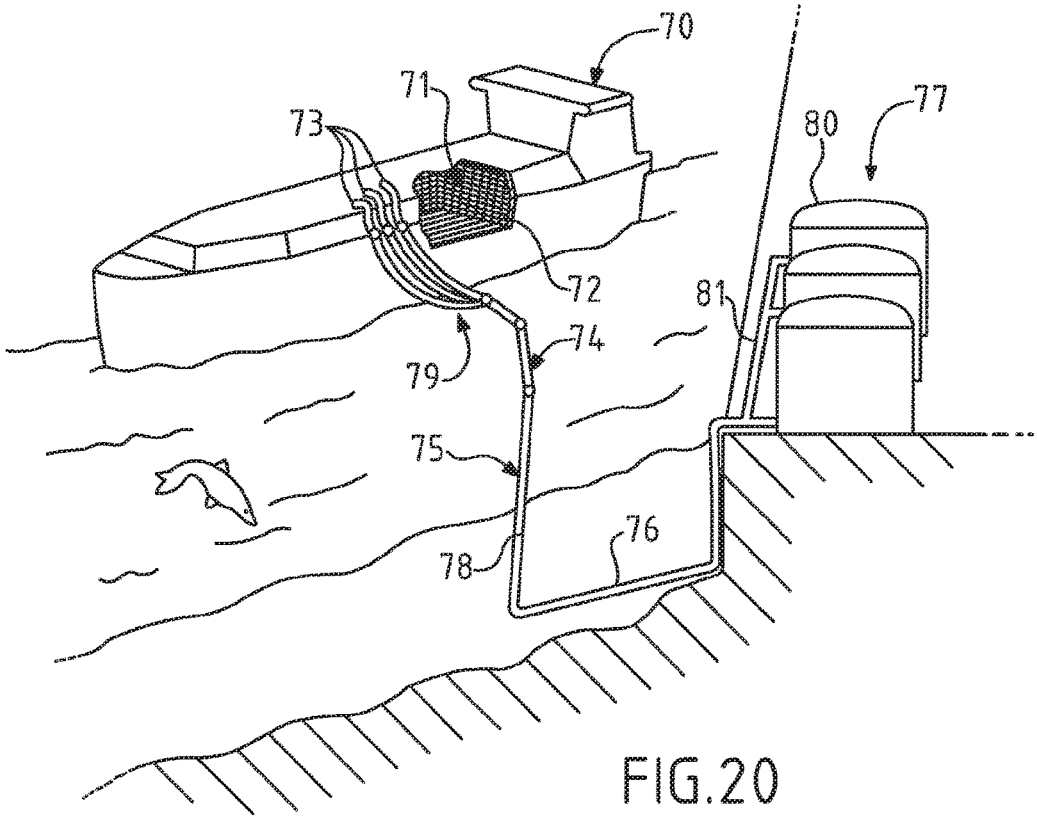
FIG. 20 is a diagrammatic, stripped-down representation of a methane tanker comprising a sealed and thermally insulating tank for storage of a fluid, and of a loading/unloading terminal for this tank.

With reference to FIG. 20, a stripped-down view of a methane tanker 70 shows such a sealed and insulated tank 71 of generally prismatic form, mounted in the double hull 72 of the ship.

In a manner known in itself, loading/unloading pipelines 73 arranged on the upper deck of the ship may be connected using suitable connectors to a maritime or port-based terminal in order to transfer an LNG cargo from or to the tank 71.

FIG. 20 also shows an example of a maritime terminal comprising a loading and unloading station 75, a submarine pipeline 76 and a land-based installation 77. The loading and unloading station 75 is a fixed off-shore installation comprising a mobile arm 74 and a tower 78 which carries the mobile arm 74. The mobile arm 74 carries a bundle of insulated flexible hoses 79 which can be connected to the loading/unloading pipelines 73. The orientable mobile arm 74 can adapt to any size of methane tanker. A connecting pipe (not shown) extends inside the tower 78. The loading and unloading station 75 allows the loading and unloading of the methane tanker 70 from or to the land-based installation 77. The latter comprises liquefied gas storage tanks 80 and connecting pipes 81 connected by the submarine pipeline 76 to the loading or unloading station 75. The submarine pipeline 76 allows the transfer of liquefied gas between the loading or unloading station 75 and the land-based installation 77 over a large distance, for example 5 km, which allows the methane tanker 70 to remain at a great distance from the shore during the loading and unloading operations.

In order to create the pressure necessary for the transfer of liquefied gas, on-board pumps in the ship 70 are used, and/or pumps fitted in the land-based installation 77, and/or pumps fitted to the loading and unloading station 75.

Although the invention has been described in connection with several particular embodiments, it is evident that it is in no way limited thereto and comprises all technical equivalents of the means described and their combinations if these fall within the scope of the invention.

The use of the verbs "comprise", "contain" and "include" and their conjugated forms does not exclude the presence of other elements or other steps than those listed in a claim. The use of the indefinite article "a" or "an" for an element or a step does not, unless specified otherwise, exclude the presence of a plurality of such elements or steps.

In the claims, any reference numeral in brackets should not be interpreted as limiting the claim.

The invention claimed is:

1. A sealed and thermally insulating tank intended for transport of a fluid, said tank comprising a tank wall fixed to a carrier wall (99), the tank wall comprising:

a sealing membrane (69) intended to be in contact with the fluid contained in the tank, the sealing membrane comprising a layer of corrugated metal sheet with at least one series of parallel corrugations (6) protruding towards the inside of the tank, and flat portions situated between the corrugations, a thermal insulation barrier (51, 53) arranged between the carrier wall and the sealing membrane and having a support surface (58, 68) on which the flat portions of the sealing membrane rest, and a reinforcing piece (15, 115, 215, 315) for reinforcing the sealing membrane against the pressure of the fluid contained in the tank, the reinforcing piece comprising a main body (16, 116) inserted in a corrugation of the sealing membrane between the sealing membrane and the support surface, the main body having an elongate form in a longitudinal direction of the corrugation and a base surface (18) resting on the support surface, wherein the thermal insulation barrier comprises a groove (83, 84, 183, 184, 36, 37) parallel to the longitudinal direction of the corrugation and opening through the support surface, and the reinforcing piece comprises a retaining rib (17, 117) protruding relative to the base surface of the main body and engaged in the groove of the thermal insulation barrier, the retaining rib forming a first end lug (22, 122) extending in the groove beyond a first longitudinal end of the main body in the longitudinal direction of the corrugation, the tank wall also comprising a stop element (24, 124, 224, 324, 424, 524, 624, 724) attached to the thermal insulation barrier and arranged on the support surface at a position adjacent to the first longitudinal end of the main body level with the first end lug (22, 122), such that the stop element cooperates with the first longitudinal end of the main body to stop the reinforcing piece in the longitudinal direction of the corrugation in a first direction, and with the first end lug to stop the reinforcing piece in a direction moving away from the support surface.

2. The tank as claimed in claim 1, wherein the retaining rib (17, 117) forms a second end lug (22, 122) extending in the groove beyond a second longitudinal end of the main body in the longitudinal direction of the corrugation, the tank wall also comprising a second stop element attached to the thermal insulation barrier and arranged on the support surface at a position adjacent to the second longitudinal end of the main body level with the second end lug, such that the second stop element cooperates with the second longitudinal end of the main body to stop the reinforcing piece in the longitudinal direction of the corrugation in the second direction, and with the second end lug to stop the reinforcing piece in the direction moving away from the support surface of the thermal insulation barrier.

3. The tank as claimed in claim 2, wherein the retaining rib (17, 117) has a length which is greater than the length of the main body (16, 116), so as to extend over the entire length of the main body and form the first end lug (22, 122) and the second end lug (22, 122) extending in the groove beyond the two longitudinal ends of the main body in the longitudinal direction of the corrugation.

4. The tank as claimed in claim 1, wherein the retaining rib (17) is positioned halfway across the width of the base surface of the main body.

5. The tank as claimed in claim 1, wherein the retaining rib is a first retaining rib (117) which is laterally offset in a first direction relative to half the width of the base surface (18) of the main body, and wherein the reinforcing piece (215, 315) also comprises a second retaining rib (117) protruding relative to the base surface of the main body and laterally offset in a second direction relative to half the width of the base surface (18) of the main body, the thermal insulation barrier also comprising a second groove (36, 37) parallel to the longitudinal direction of the corrugation, which opens through the support surface and in which the second retaining rib is engaged, the second retaining rib forming an end lug (122) extending in the second groove beyond the first or second longitudinal end of the main body in the longitudinal direction of the corrugation, the tank wall also comprising a stop element attached to the thermal insulation barrier and arranged on the support surface at a position adjacent to the first or second longitudinal end of the main body level with the end lug of the second retaining rib, such that the stop element cooperates with the first or second longitudinal end of the main body to stop the reinforcing piece in the longitudinal direction of the corrugation in the first or second direction, and with the end lug of the second retaining rib to stop the reinforcing piece in the direction moving away from the support surface.

6. The tank as claimed in claim 1, wherein the or each stop element (24, 124, 224, 324, 424, 524, 624, 724) straddles the groove in which the first or second end lug, that must cooperate with the stop element, is engaged.

7. The tank as claimed in claim 1, wherein the or each stop element (24, 324, 424, 624) is attached to the thermal insulation barrier on a single side of the groove in which the first or second end lug, that must cooperate with the stop element, is engaged.

8. The tank as claimed in claim 6, wherein the or each stop element (124, 224, 524) is attached to the thermal insulation barrier on both sides of the groove in which the first or second end lug, that must cooperate with the stop element, is engaged.

9. The tank as claimed in claim 1, in which the reinforcing piece (15) also comprises a thickness shim (26, 27) fixed to a side face of the retaining rib (17) to adapt a thickness of the retaining rib to a width of the groove in which the retaining rib is engaged.

10. The tank as claimed in claim 3, wherein the reinforcing piece comprises an elongate shim (27) of the same length as the retaining rib (17), the elongate shim having a U-shaped profile engaged on the retaining rib by the open side of the U-shaped profile, and having a first and a second fixing tab (28) straddling the open side of the U-shaped profile at the two longitudinal ends of the elongate shim, in order to cooperate with an upper surface of the first end lug (22) and an upper surface of the second end lug (22).

11. The tank as claimed in claim 10, wherein the first and second stop elements (324, 424) are formed integrally with the elongate shim.

12. The tank as claimed in claim 1, wherein the main body (16, 116) of the reinforcing piece has a hollow tubular form open at the two longitudinal ends (23) of the main body.

13. The tank as claimed in claim 1, wherein the reinforcing piece is a first reinforcing piece (15, 115), the tank also comprising a second reinforcing piece (15, 115) comprising a main body inserted in said corrugation of the sealing membrane between the sealing membrane and the support surface in the alignment of the first reinforcing piece, on the side of the first longitudinal end of the first reinforcing piece, the main body of the second reinforcing piece having an elongate form in the longitudinal direction of the corrugation and a base surface resting on the support surface, the second reinforcing piece comprising a retaining rib (17) protruding relative to the base surface of the main body and engaged in the groove (83, 84) of the thermal insulation barrier, the retaining rib forming a first end lug extending in the groove beyond a first longitudinal end of the main body turned towards the first longitudinal end of the first reinforcing piece, and wherein the stop element (524, 624, 724) is arranged on the support surface between the first longitudinal end of the first reinforcing piece (15, 115) and the first longitudinal end of the second reinforcing piece (15, 115), level with the first end lugs of the first reinforcing piece and of the second reinforcing piece, such that the stop element cooperates with the first longitudinal ends of the main bodies of the first reinforcing piece and the second reinforcing piece, and with the first end lugs of the first reinforcing piece and the second reinforcing piece.

14. The tank as claimed in claim 1, wherein the layer of corrugated sheet metal has a first series of parallel corrugations (6) protruding towards the inside of the tank, and also a second series of parallel corrugations (5) protruding towards the inside of the tank, and extending in a direction intersecting the first series of corrugations, the corrugations of the first series of corrugations and the corrugations of the second series of corrugations intersecting at intersection points (3), wherein the thermal insulation barrier comprises a first groove (83, 84) aligned with the longitudinal direction of a corrugation (6) of the first series and opening through the support surface, and also a second groove (183, 184) aligned with the longitudinal direction of a corrugation (5) of the second series and opening through the support surface, the first groove and the second groove intersecting at an intersection between the corrugation of the first series and the corrugation of the second series, wherein said reinforcing piece (15) belongs to a first batch of reinforcing pieces intended to reinforce the corrugations the first series of corrugations, and is engaged in the first groove at a position adjacent to the intersection between the first groove and the second groove, the first longitudinal end of the reinforcing piece of the first batch being turned towards the intersection between the first groove and the second groove, the tank also comprising a second batch of reinforcing pieces intended to reinforce the corrugations of the second series of corrugations, wherein a reinforcing piece (115) of the second batch comprises a main body inserted in the corrugation of the second series between the sealing membrane and the support surface, the main body of the reinforcing piece of the second batch having an elongate form in the longitudinal direction of the corrugation of the second series and a base surface resting on the support surface, the reinforcing piece of the second batch comprising a retaining rib protruding relative to the base surface of the main body and engaged in the second groove of the thermal insulation barrier at a position adjacent to the intersection between the first groove and the second groove, the retaining rib forming a first end lug extending in the second groove beyond a first longitudinal end of the main body turned towards the intersection between the first groove and the second groove, and wherein the stop element (524, 624, 724) is arranged on the support surface at the intersection between the first groove and the second groove, level with the first end lugs of the reinforcing piece of the first batch and of the reinforcing piece of the second batch, such that the stop element cooperates with the first longitudinal end of the main bodies of the reinforcing piece of the first batch and of the reinforcing piece of the second batch and with the first end lugs of the reinforcing piece of the first batch and of the reinforcing piece of the second batch.

15. The tank as claimed in claim 14, wherein a first and a second reinforcing piece of the first batch are engaged in the first groove (83, 84) on either side of the intersection between the first groove and the second groove, and a first and a second reinforcing piece of the second batch are engaged in the second groove (183, 184) on either side of the intersection between the first groove and the second groove, the stop element (524, 624, 724) arranged at the intersection between the first groove and the second groove cooperating with the first longitudinal ends of the main bodies of the first and second reinforcing pieces of the first batch and of the first and second reinforcing pieces of the second batch, and with the first end lugs of the first and second reinforcing pieces of the first batch and of the first and second reinforcing pieces of the second batch.

16. A ship (70) for the transport of a fluid, the ship comprising a double hull (72) and a tank (71) as claimed in claim 1 arranged in the double hull.

17. A method for loading or unloading of a ship (70) as claimed in claim 16, wherein a fluid is conducted through insulated pipelines (73, 79, 76, 81) from or to a floating or land-based storage installation (77), to or from the ship's tank (71).

18. A transfer system for a fluid, the system comprising a ship (70) as claimed in claim 16, insulated pipelines (73, 79, 76, 81) arranged so as to connect the tank (71) installed in the hull of the ship to a floating or land-based storage installation (77), and a pump for driving a fluid through the insulated pipelines from or to the floating or land-based storage installation, to or from the ship's tank.

* * * * *